US009192214B2

(12) United States Patent
Gambill

(10) Patent No.: US 9,192,214 B2
(45) Date of Patent: Nov. 24, 2015

(54) POLE CADDY FOR DISPLAY OF INDICIA AND METHOD OF DISPLAYING SAID INDICIA

(76) Inventor: Raymond Gambill, Cape Canaveral, FL (US)

( * ) Notice: Subject to any disclaimer, the term of this patent is extended or adjusted under 35 U.S.C. 154(b) by 939 days.

(21) Appl. No.: 12/454,787

(22) Filed: May 23, 2009

(65) Prior Publication Data

US 2009/0236489 A1 Sep. 24, 2009

Related U.S. Application Data

(63) Continuation-in-part of application No. 12/011,442, filed on Jan. 25, 2008, now abandoned.

(51) Int. Cl.
*A47B 37/00* (2006.01)
*A45B 23/00* (2006.01)

(52) U.S. Cl.
CPC ..... *A45B 23/00* (2013.01); *A45B 2023/0012* (2013.01); *A45B 2200/1063* (2013.01)

(58) Field of Classification Search
USPC ..... 248/218.4, 230.1, 229.1, 229.16; 108/50.11, 50.12; 135/15.1, 98
See application file for complete search history.

(56) References Cited

U.S. PATENT DOCUMENTS

| | | | | |
|---|---|---|---|---|
| 2,805,109 | A | 9/1955 | Kopmar | |
| 3,295,473 | A | 1/1967 | Wentworth | |
| 3,624,732 | A | 11/1971 | Bowden | |
| 4,920,897 | A | 5/1990 | Reed et al. | |
| 5,197,394 | A | 3/1993 | Schmidt | |
| D366,372 | S | 1/1996 | Skarda, Jr. | |
| D388,974 | S | 1/1998 | Piker | |
| 5,740,822 | A * | 4/1998 | Einck | 135/16 |
| 5,996,511 | A | 12/1999 | Swoger | |
| 6,209,147 | B1 | 4/2001 | Wheaton | |
| 6,474,244 | B1 | 11/2002 | Karpinski | |
| 6,705,334 | B2 | 3/2004 | Altobelli | |
| 6,837,386 | B1 | 1/2005 | Kent et al. | |
| 6,889,618 | B1 | 5/2005 | Gromack | |
| 6,997,111 | B2 | 2/2006 | Giegerich | |
| 7,007,813 | B2 | 3/2006 | Yang | |
| 7,044,064 | B2 | 5/2006 | Summerfield | |
| 2002/0036008 | A1 * | 3/2002 | Hickam et al. | 135/98 |
| 2004/0129184 | A1 | 7/2004 | Kraker | |
| 2004/0139892 | A1 * | 7/2004 | Giegerich | 108/26 |
| 2005/0241546 | A1 | 11/2005 | Royse | |
| 2007/0007425 | A1 * | 1/2007 | Perotti et al. | 248/530 |
| 2007/0096004 | A1 | 5/2007 | Quiambao, Jr. | |
| 2008/0134551 | A1 * | 6/2008 | Conforti et al. | 40/506 |

FOREIGN PATENT DOCUMENTS

| | | | |
|---|---|---|---|
| JP | 40808461 | A | 4/1996 |

* cited by examiner

*Primary Examiner* — Steven Marsh
(74) *Attorney, Agent, or Firm* — Jason T. Daniel, Esq.; Daniel Law Offices, P.A.

(57) ABSTRACT

A pole caddy (10) has a planar table portion (12), a shaft-engaging portion in the form of a tubular projection (32) and a lateral surround (14) orthogonal to the planar portion (12), the lateral surround (14) including an indicia display area (15) and including a rim (14*a*) that extends above the planar table portion (12.

13 Claims, 9 Drawing Sheets

POLE CADDY FOR DISPLAY OF INDICIA AND METHOD OF DISPLAYING SAID INDICIA

CROSS-REFERENCE TO RELATED APPLICATIONS

This application is a continuation-in-part application of Ser. No. 12/011,442, filed Jan. 25, 2008 now abandoned.

TECHNICAL FIELD

This invention relates generally to tables and more particularly to tables supportable upon generally elongated supports, such as umbrella poles. Still more particularly, it relates to such tables that are capable of displaying various indicia, for example, illustrations of mascots or logos of schools or professional sporting teams and to methods for achieving such display of indicia.

BACKGROUND ART

Various tables supported on shafts, such as the support pole of a beach umbrella, are known and are shown, for example, in U.S. Pat. Nos. 4,920,897 and 6,889,618 and published U.S. Patent Application No. 2004/0129184. Such tables are often called pole caddies, by which term they will be referred to herein. While these tables provided a surface, which may or may not include pockets of various sizes or depths, they lacked sufficient strength for long-term use and further, did not provide a means for users to display their pride in, or allegiance, to a sports team, or other unique organization. Further, the tables of the prior art were singularly absent in any capability for handling vessels with laterally projecting handles or for reducing the tendency of articles thereon to slide off or blow off in windy conditions.

DISCLOSURE OF INVENTION

It is, therefore, an object of the invention to obviate the disadvantages of the prior art.

It is another object of the invention to improve shaft-supportable tables.

Yet another object of the invention is the enhancement of such tables and the provision of an area on such tables for the display of indicia.

Yet another object of the invention is the enhancement of shaft-supportable tables.

Still another object of the invention is the provision of a shaft-supportable table that includes structure for maintaining objects in place in windy conditions.

Still another object of the invention is the provision of a method for displaying indicia.

These objects are accomplished, in one aspect of the invention, by a pole caddy comprising: a planar table portion; and a lateral surround orthogonal to the planar portion, and of a size sufficient to provide added strength as well as an indicia display area.

These objects are further accomplished by provision of a pole caddy having an upstanding rim surrounding the planar table portion.

The objects are also accomplished in the provision of a table that adequately handles all sorts of vessels, including those with laterally projecting handles.

The objects are further accomplished in another aspect of the invention by the provision of a kit containing all of the necessary ingredients for providing a pole caddy with all of the accoutrements to display one's affiliation.

The objects are further accomplished by a method of providing the display of indicia, which comprises the steps of forming a table including a relatively large peripheral side and adding identifying indicia to the peripheral sides.

The objects are still further accomplished by the provision of table having sides on which the indicia may changed at will.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
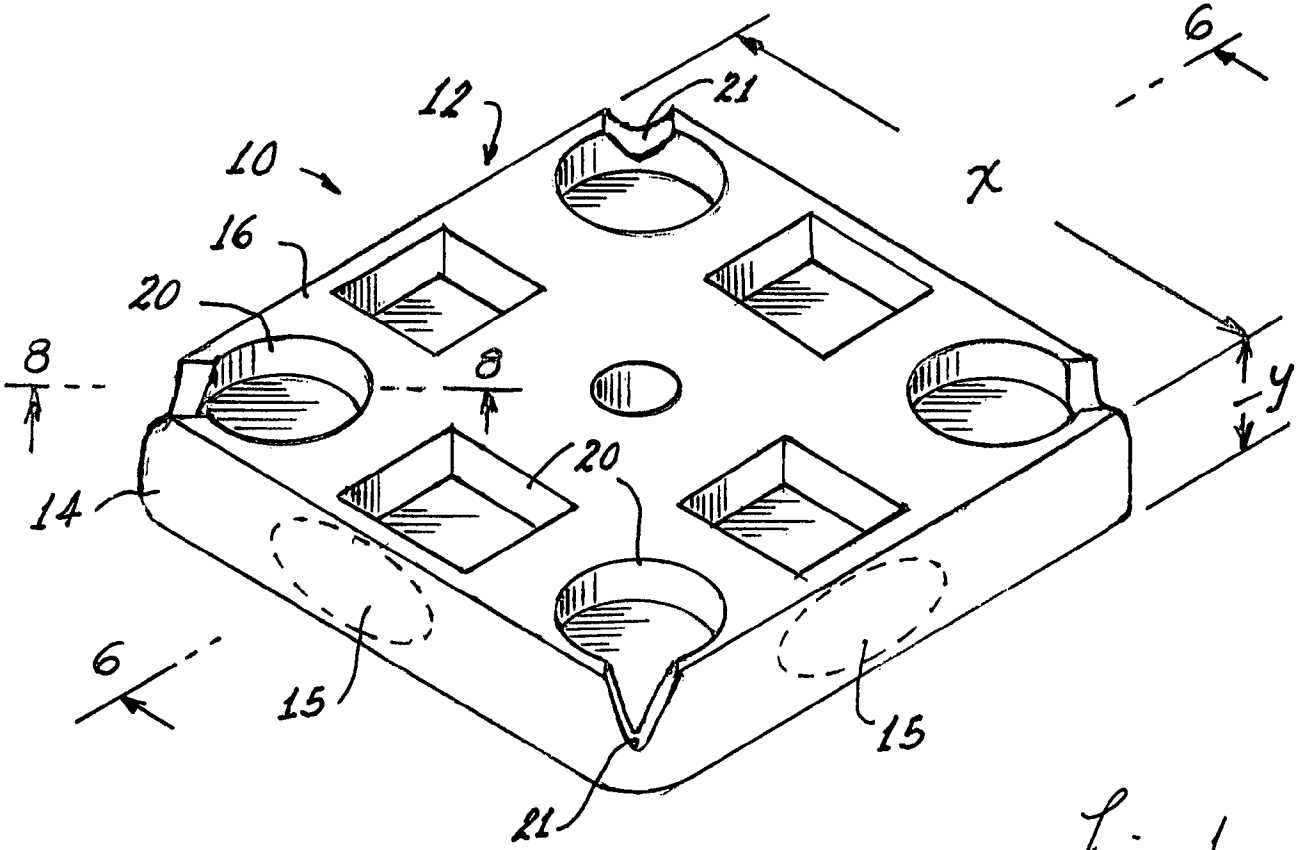
FIG. 1 is a perspective view of an embodiment of the invention.
Figure 2:
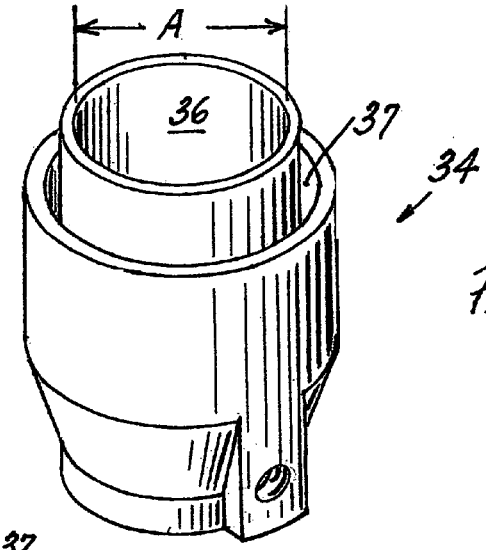
FIG. 2 is a perspective view of a support for a pole caddy.
Figure 3:
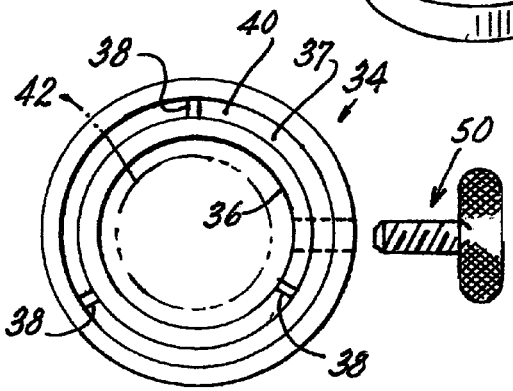
FIG. 3 is a plan view of a support.
Figure 4:
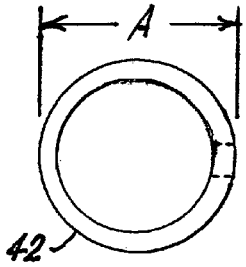
FIG. 4 is a plan view of a bushing that can be employed with the support.

Referring now to the drawings with greater particularity, there is shown in FIG. 1 a pole caddy 10 comprising a planar table portion 12 and a lateral surround 14 orthogonal to the planar portion 12, the lateral surround 14 including an indicia display area 15. The pole caddy is preferably formed from a moldable material, such as, for example, reinforced polypropylene, and the indicia display area is large enough to display illustrations of mascots or other logos to indicate the aforementioned allegiance to a sport team, or, perhaps, loyalty to a company.

The planar table portion 12 has a given width X and the lateral surround 14 has a height Y equal to or greater than 0.18 times the given width. Such dimensions provide strength to the table portion and provide adequate space for the display of the desired indicia. In a specific embodiment the planar table portion X is between 13 and 14 inches and the height Y is between 2.5 and 3 inches.

The planar table portion 12 includes an upper surface 16 and a bottom surface 18. The upper surface is provided with a plurality of pockets 20 and a tubular projection 32 is formed with a bottom surface 18 of the planar portion 12. The tubular projection 32 receives the shaft of the supporting unit, as will be explained hereinafter.

Figure 8:
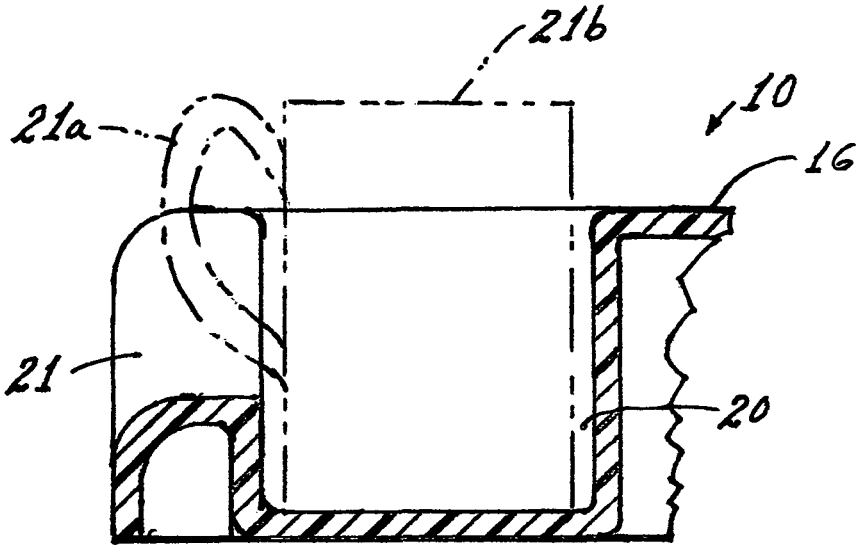
FIG. 8 is a sectional view taken along the line 8-8 of FIG. 1.

The plurality of pockets 20 can comprise multiple configurations and, as illustrated, circular and square or rectangular configurations are suitable. In a preferred embodiment of the invention at least one of the pockets 20 has a depressed channel 21 leading from the interior of a pocket 20 to the lateral surround 14, the channel 21 providing a receptor for a laterally projecting handle 21*a* of a vessel 21*b*, as shown more clearly in FIG. 8.

Figure 9:
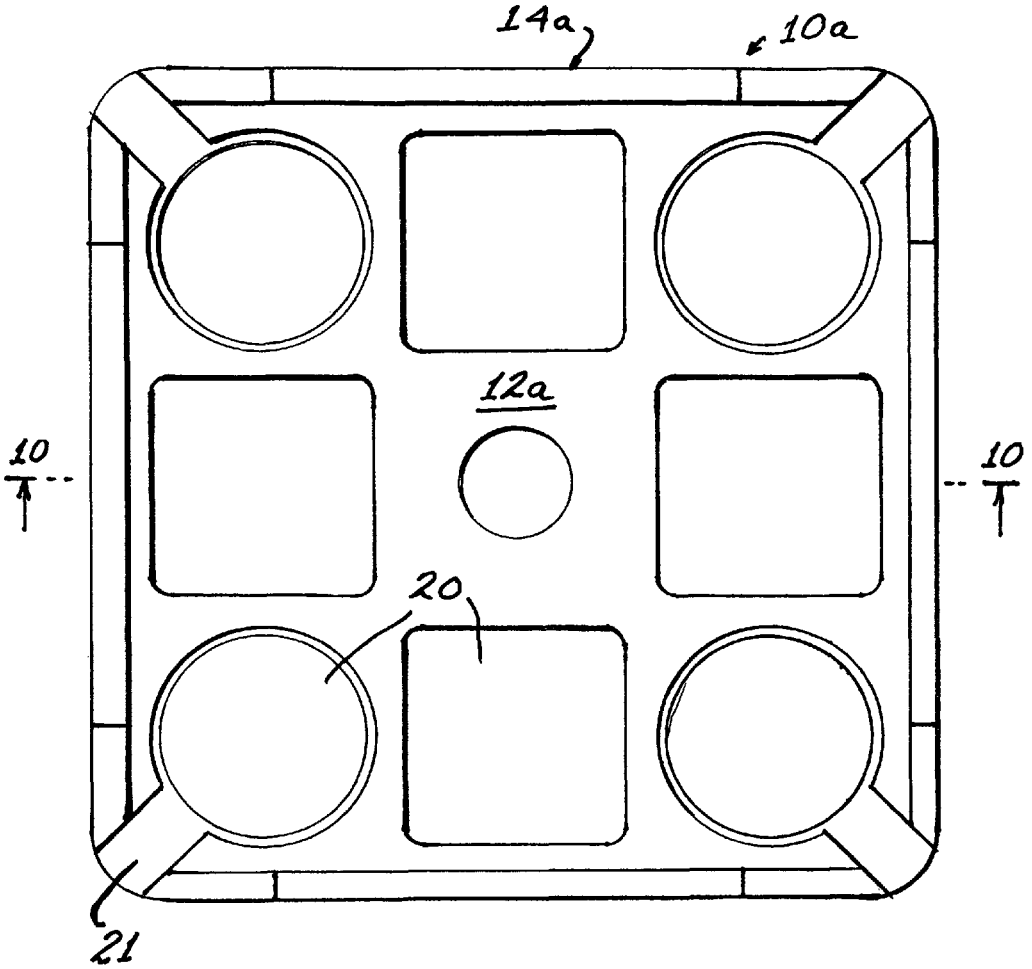
FIG. 9 is plan view of another embodiment of the invention.
Figure 10:
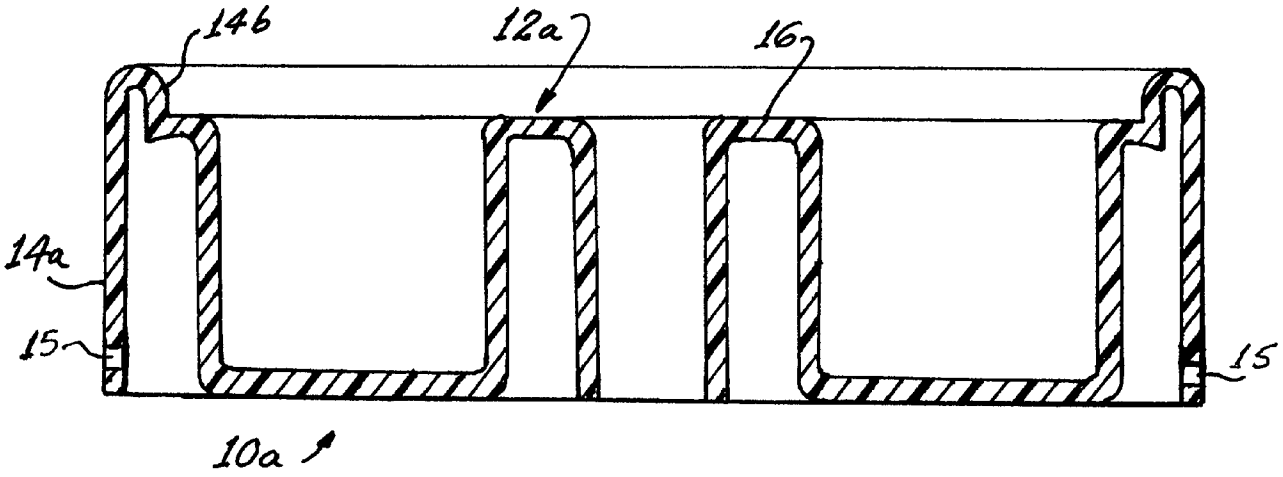
FIG. 10 is a sectional view taken along the line 10-10 of FIG. 9.

An alternate embodiment of the table is shown in FIGS. 9 and 10 wherein a table 10*a* has a planar portion 12*a* and a lateral surround 14*a* that extends above and below the plane of the planar portion 12*a* thus providing an upstanding rim 14*b* that aids in preventing objects placed on the table surface from sliding or blowing off. Additionally, if desired, the bottom portion of the lateral surround 14 can be provided with a plurality of apertures 15 for hanging articles.

Figure 12:
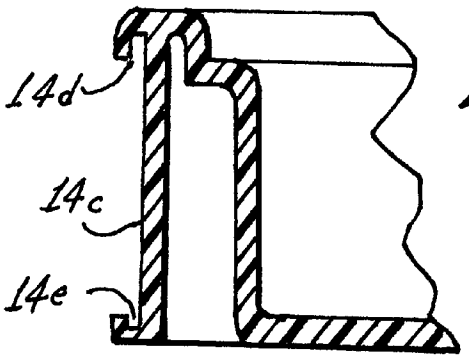
FIG. 12 is a partial, sectional view of an alternate embodiment of the invention.
Figure 11:
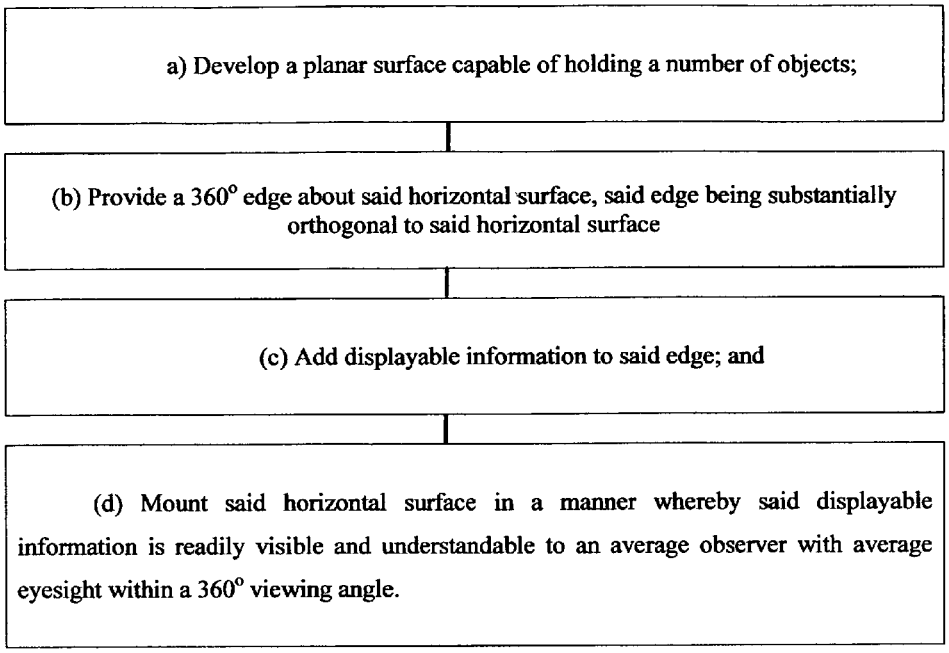
FIG. 11 is a flow diagram of a method of displaying indicia.

Another embodiment of the invention is shown in the partial sectional view of FIG. 12, wherein a table 10*b* has a lateral surround 14*c* provided with upper and lower rabbets 14*d* and 14*e* respectively, allowing indicia to be provided on removable panels so that the indicia can be changed at will. The rabbets 14*d* and 14*e* can be molded in to the table ab initio or can be added in the form of clips that attach to the rim 14*b* and the bottom edge of the lateral surround 14*a*.

Figure 5A:
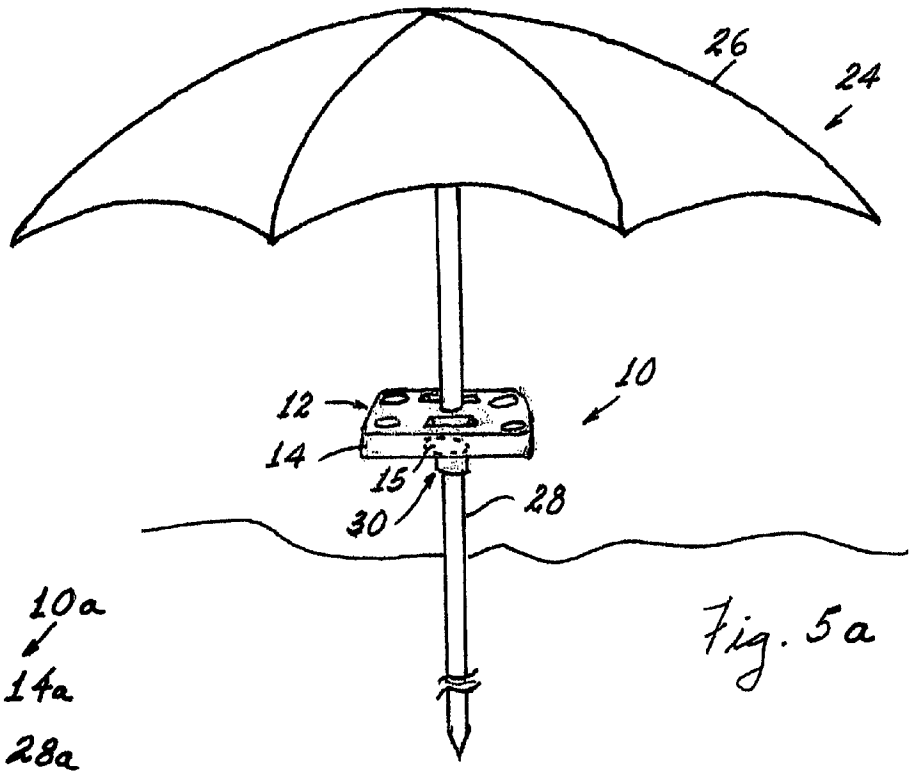
FIG. 5*a* is a perspective view of a pole caddy mounted upon an elongated shaft that can be inserted into the ground for support.
Figure 5B:
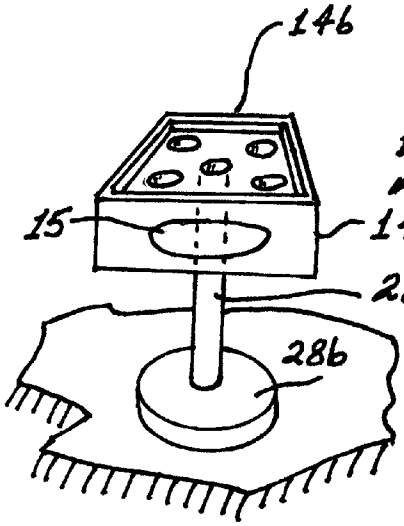
FIG. 5*b* is a perspective view of a pole caddy mounted upon a shaft that includes a base for display on a more solid surface.
Figure 6:
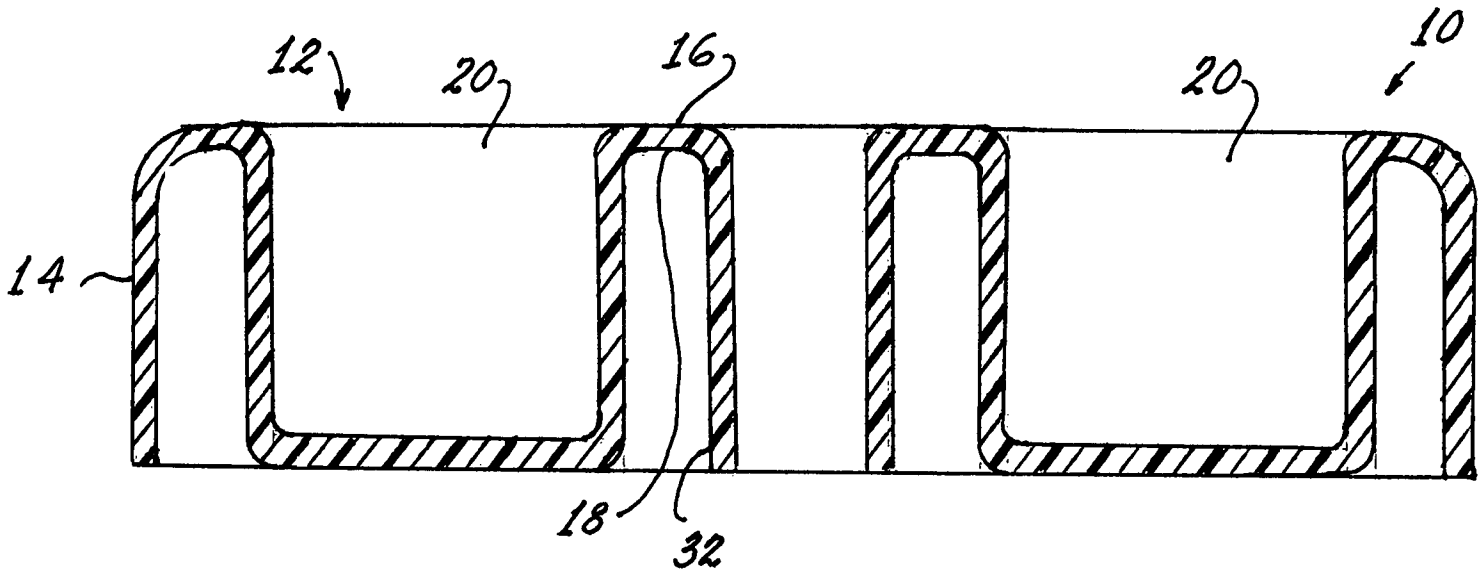
FIG. 6 is a sectional view taken along the line 6-6 of FIG. 1.
Figure 7:
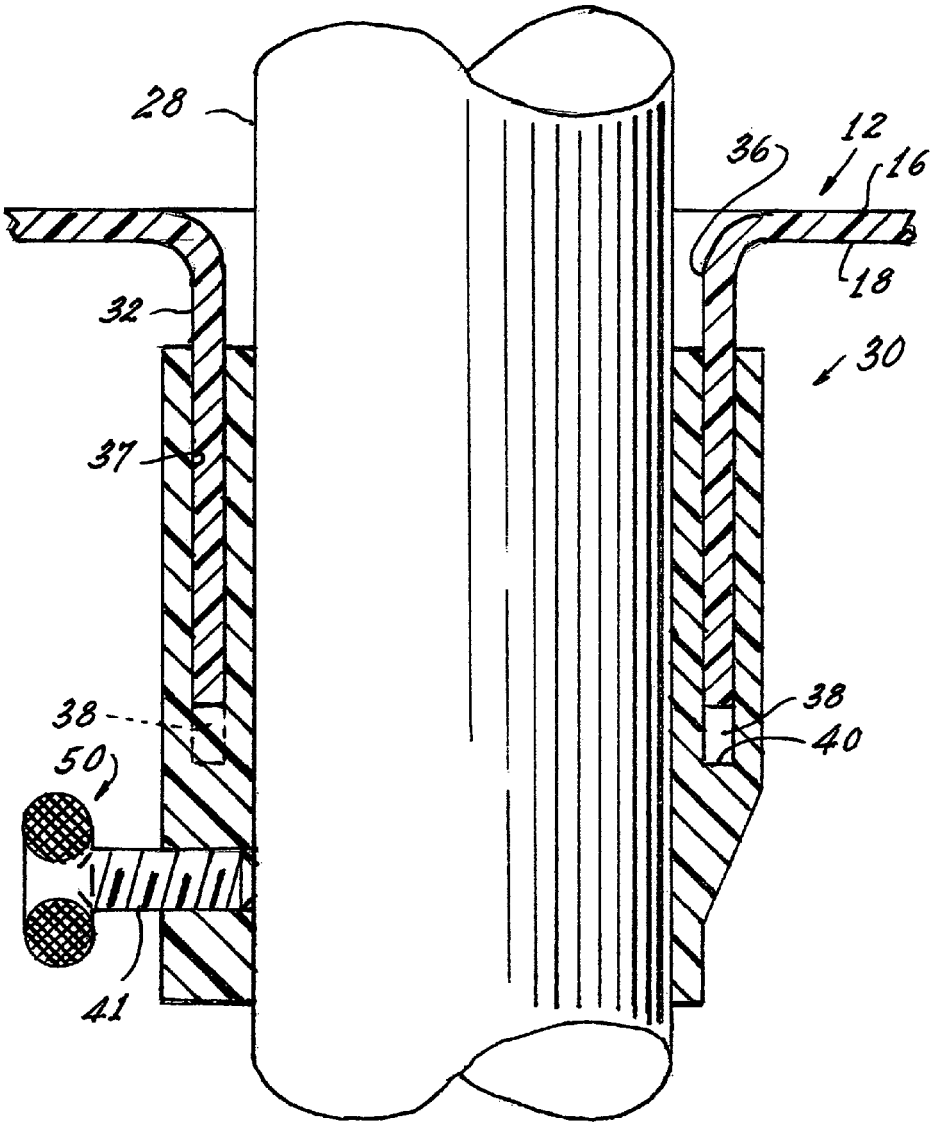
FIG. 7 is a sectional view, with some parts omitted, of the mounting structure.

In either version of the table, that is, table 10, 10*a* or 10*b*, a mount 30 is provided for affixing the table to a support, such as the elongated shaft 28 of an umbrella 24, as shown in FIG. 5*a* or the shorter shaft 28*b* of FIG. 5*b*.

The mount 30 comprises the tubular projection 32 formed on the bottom surface 18 of the planar portion 12 and a pole caddy support 34 having a central opening 36 with a diameter A to receive the shaft 28 (or a bushing 42) and an annular receptor 37 to receive the tubular projection 32. Feet 38 (preferably 3 in number, spaced 120° apart) are formed on a bottom 40 of the annular receptor 36 to support the tubular projection 32. The feet 38 insure that the pole caddy 10 is firmly supported. An engager 50, which can take the form of a thumbscrew 41, is provided for fixing and releasing the pole caddy support 34 to the elongated shaft 28.

In an embodiment of the invention the pole caddy 10 and its support 34 can comprise a part of a kit that can include an umbrella 24 having an expandable canopy 26 and an elongated shaft 28. In a preferred embodiment of the invention, the kit would includes the pole caddy 10, the support 34 and one or more bushings 42, for example, a bushing 42 having an outside diameter A to match the internal diameter of the support 34 formed to fit inside the central opening 36 of the pole caddy support 34 to accommodate multiple shaft diameters in the event it becomes necessary to use a shaft from, for example, a rented umbrella.

Alternatively, the kit can comprise a shorter shaft 28*a* and a base 28*b* for use, for example, at a swimming pool or other location where an umbrella would be undesired or where a shaft could not conveniently be inserted into the ground. The base 28*b*, of course, can be used with any embodiment, According to another aspect of the invention, a method of displaying information in an outdoor setting comprises the steps of (a) developing an article with a planar surface, for example, the top of a table capable of holding at least a plurality of objects; (b) providing a 360° lateral surround orthogonal to the planar surface, the lateral surround including an indicia display area; (c) adding displayable information to the lateral surround; and (d) mounting the article in a manner whereby the displayable information is readily visible and understandable to an average observer with average eyesight within a 360° viewing angle.

For example, in the case of the article described above, that is, a table, the planar surface can be square or rectangular and thus the lateral surround would of necessity have four sides, each of which would display a similar (or preferably identical) message that would be visible to any person on any side of the table.

While the indicia can comprise virtually any intelligence conveying data, the indicia is ideally suited to the display of college mascots or sports' team's logos.

Thus, there is provided a pole caddy for displaying indicia and a method for achieving the display of the indicia. A kit is provided also that is strong and easy to assemble and that has a specific provision for the inclusion of display indicia. Further, in a preferred kit version the pole caddy has the capability of accepting multiple diameter shafts.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A pole caddy, comprising:

a planar table portion that includes an upper surface having an umbrella shaft receiver that is disposed along a central portion thereof, a bottom surface, a plurality of pockets that are disposed along the upper surface and extend toward the bottom surface, and a lateral surround surface that is in orthogonal communication with a periphery of each of the upper surface and the bottom surface, said lateral surround including an indicia display area that functions to receive and display indicia from a 360° viewing angle and at a substantial distance away from said lateral surround; and a shaft mount that is in communication with the bottom surface, said shaft mount consisting of a tubular projection that is permanently affixed along a center portion of the bottom surface, a pole caddy support having a central opening and a first diameter that is configured to receive each of an elongated shaft and a bushing, an annular receptor having a pair of spaced feet, said receptor being configured to engage and receive the tubular projection located on the bottom surface of the planar table portion, and an engager that functions to secure the pole caddy support to each of the elongated shaft and the bushing.

2. The pole caddy of claim 1 wherein said lateral surround extends above and below said upper and bottom surfaces.

3. The pole caddy of claim 1 wherein the plurality of pockets include at least one pocket having a generally circular shape, and another pocket having a generally square shape.

4. A kit comprising:

an elongated shaft having a first end and a second end;

a pole caddy, comprising a planar table portion that includes an upper surface having an umbrella shaft receiver that is disposed along a central portion thereof, a bottom surface, a plurality of pockets that are disposed along the upper surface and extend toward the bottom surface, and a lateral surround surface that is in orthogonal communication with a periphery of each of the upper surface and the bottom surface, said lateral surround including an indicia display area that functions to receive and display indicia from a 360° viewing angle and at a substantial distance away from said lateral surround; and a shaft mount for securing the pole caddy to the first end of the shaft, said shaft mount consisting of a tubular projection that is permanently affixed along a center portion of the bottom surface of the planar table portion, a pole caddy support having a central opening and a first diameter that is configured to receive each of a bushing and the first end of the elongated shaft, an annular receptor having a pair of spaced feet, said receptor being configured to engage and receive the tubular projection located on the bottom surface of the planar table portion, and an engager that functions to secure the pole caddy support to each of the elongated shaft and the bushing; and an umbrella having an expandable canopy and an umbrella shaft, said umbrella shaft being configured to engage the umbrella shaft receiver of the upper surface of the planar table.

5. The kit of claim 4 wherein at least one secondary bushing is provided, the bushing being formed to fit inside the central opening of the pole caddy support.

6. The pole caddy of claim 3 wherein at least one of said pockets has a depressed channel leading from an interior of the at least one pocket to the lateral surround.

7. The device of claim 1, further comprising:

a plurality of apertures that are disposed along the lateral surround.

8. The device of claim 1, further comprising:

a pair of upper and lower rabbets that are disposed along the lateral surround; and one or more removable panels that are configured to removably engage the upper and lower rabbets.

9. The device of claim 8, wherein each of said one or more removable panels include indicia.

10. The kit of claim 4, further comprising:

a base that is configured to engage the second end of the elongated shaft.

11. The kit of claim 4, further comprising:

a plurality of apertures that are disposed along the lateral surround.

12. The kit of claim 4, further comprising:

a pair of upper and lower rabbets that are disposed along the lateral surround; and one or more removable panels that are configured to removably engage the upper and lower rabbets.

13. The kit of claim 12, wherein each of said one or more removable panels include indicia.

* * * * *